US007363662B1

(12) United States Patent
Broyles

(10) Patent No.: US 7,363,662 B1
(45) Date of Patent: Apr. 29, 2008

(54) STOPRZ

(75) Inventor: Ray Francis Broyles, Springfield, MO (US)

(73) Assignee: Ray Broyles, Springfield, MO (US)

( * ) Notice: Subject to any disclaimer, the term of this patent is extended or adjusted under 35 U.S.C. 154(b) by 0 days.

(21) Appl. No.: 11/246,964

(22) Filed: Oct. 7, 2005

(51) Int. Cl.
*E03D 1/00* (2006.01)

(52) U.S. Cl. ..... 4/353; 137/390

(58) Field of Classification Search ..... 4/353, 4/415, 410, 411; 137/389, 390; 251/89, 251/90

See application file for complete search history.

(56) References Cited

U.S. PATENT DOCUMENTS

| | | | | | |
|---|---|---|---|---|---|
| 1,536,358 | A | * | 5/1925 | Stacey, Jr. | 4/353 X |
| 2,543,438 | A | * | 2/1951 | Cochran | 4/411 |
| 5,083,323 | A | * | 1/1992 | Cannan | 4/415 |
| 5,232,011 | A | * | 8/1993 | Royalty | 4/324 X |
| 5,327,931 | A | * | 7/1994 | Royalty et al. | 4/324 X |
| 5,881,400 | A | * | 3/1999 | Arnold | 4/415 |

* cited by examiner

*Primary Examiner*—Robert M. Fetsuga

(57) ABSTRACT

Many times when a home sewage line becomes clogged it results in overflow of the matter in the toilet bowl onto the floor. It is a difficult matter at the time to easily and immediately stop overflowing from occurring. STOPRZ solves this problem. If the affluent in the bowl keeps rising to an uncomfortable level one only has to raise the finial atop the toilet tank lid. Since the finial is connected to the lift-bar of the shut-off valve controlling the water flow into the toilet bowl by the brass rod, raising the finial shuts the inflow of water. Spinning the wing nut down to the top of the toilet tank lid shuts off the water supply for as long as is necessary. Correcting the complete problem can then be done at one's leisure. STORZ consists of three items—a lift-rod shaft (a ⅛ by 6 inch rod threaded at one end and the other end curved into a semi-circle as the curved end of a fish-hook), a wing nut and a finial. Shaft is slipped thru a hole in the toilet tank lid with the curved end around the toilet lift-rod. The wing nut is threaded onto the top (threaded end of the shaft) followed by the finial. This leaves the wing nut and the finial exposed on top of the toilet tank lid. The hook part of STOPRZ is below the lid and hooked around the lift-rod of the water entry valve. Lifting the finial lifts the toilet lift-rod and closes the valve shutting off water to the toilet bowl. Spinning the wing nut down makes this condition as permanent as one desires.

1 Claim, 1 Drawing Sheet

STOPRZ

FIELD-PLUMBING

The purpose of the device (invention) is to afford easy and immediate ability to stop the passage of water in the toilet tank into the toilet bowl and thereby stop the overflowing of the water and affluents over the top of the toilet bowl onto the floor.

This is normally caused by a stoppage in a subsidiary line or the main household sewer line running from the home to the main sewer line.

DRAWING EXPLANATION

FIGS. 1A,1B and 1C comprise the device "STOPRZ".

Figure 1C:
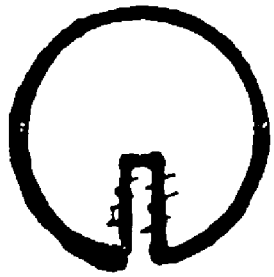
FIG. 1A IS A 1/8 inch diameter by 3 inch length rod with one end (the top end) threaded and the other end (the bottom end) formed into a hook shape.
FIG. 1B is a wing nut.
Figure 1B:
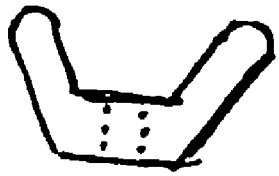
Figure 1A:
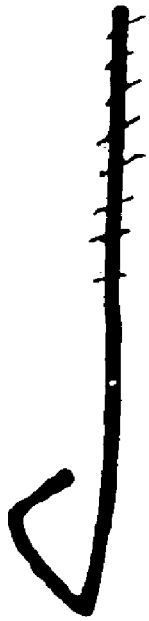

FIG. 1C is a final. The rod is placed through a hole in the toilet tank lid, with the threaded section above the toilet tank lid and with the bottom (hook shaped) below the tank lid. The wing nut is screwed (spun) down the threaded section And the finial is then screwed onto the top of the rod. The bottom section(hook shaped) is then encircled the lift-arm of the water inlet valve. Lifting the finial-which sits above the toilet tank lid immediatley turns off The water supply to the tank and toilet bowl since it is directly connected to the lift-arm of the water inlet valve. The wing nut is then screwed (spun) down to the upper surface of The toilet tank lid providing as permanent a stoppage of water To the toilet tank and bowl as desired and prevents any spillage of water, ect. onto the floor of the bathroom

CONSTRUCTION OF THE DEVICE

One end (the bottom end) of a ⅛ by 6 inch brass rod (a toilet tank lift rod) is formed into a semi-circle such as the curved end of a fishhook. Upon the other end (the top end) a brass wing-nut and then a finial are screwed

DETAILED DESCRIPTION OF THE PREFERRED EMBODIMENT

STOPRZ consists of three items.

A-A ¼ by 6 inch elongate brass rod (a toilet tank float rod threaded on both ends). The length of the rod determined by the need, easily shortened by cuttine off the bottom end to the extent of obtaining the desired length. This results in the rod being the length desired with one end threaded and the other (the bottom end not threaded.

B-A wing-nut of a size to fit the top end of the brass rod.

C-A finial—of a size to fit the top (threaded end) of the brass rod.

The top end of A (the brass rod) is slipped through a hole F drilled into the lid D of the toilet tank. The wing-nut is screwed onto the top portion of the rod followed by the finial fastening the rod to the lid. The bottom end (curved end) is then placed around the lift-arm E of water inlet valve G.

This results in the wing-nut and the finial resting on top of the toilet tank lid and the curved end of the shaft being below the lid and partially encircling the lift-arm of the shut off valve.

Preventing matter from rising above normal level in toilet bowl can easily ber accomplished by raising finial.

Spinning the wing-nut down to the top of the toilet tank lid makes the stoppage permanent or until the situation is corrected.

USAGE

Many times, every day, normally because of stoppages in sewer lines, the matter (water and affluents) overflow from the toilet bowl onto the floor, rug, etc. This is the cause of damage and much angst.

STOPRZ affords a very easy and quick method of stopping this flow of affluents before any damage can occur.

A person using the facility need only to reach over to the finial, lift it and then spin the wing nut to the top of the toilet tank lid.

Third immediately solves the problem. Action to correct the initial problem can then be taken at one's leisure.

The invention claimed is:

1. In combination with a toilet tank lid having a through hole therein, and a water inlet valve having a lift arm, a device comprising:

an elongate rod having a hook at one end and being threaded at the other end;

a nut engaging the rod threaded end; and a finial engaging the rod threaded end;

wherein the threaded end of the rod extends through the hole in the lid and is fastened to the lid by the nut and finial, and wherein the hook partially encircles the lift arm, whereby the lift arm can be secured in a raised position to shut off the inlet valve by threading the nut against the lid.

* * * * *